US009186704B2

(12) United States Patent
Kirschbauer et al.

(10) Patent No.: US 9,186,704 B2
(45) Date of Patent: Nov. 17, 2015

(54) METHOD AND DEVICE FOR SORTING IDENTIFICATION OBJECTS

(75) Inventors: Maximilian Kirschbauer, Bad Koetzting (DE); Thomas Valta, Schorndorf (DE)

(73) Assignee: Muehlbauer GmbH & Co. KG, Roding (DE)

( * ) Notice: Subject to any disclaimer, the term of this patent is extended or adjusted under 35 U.S.C. 154(b) by 106 days.

(21) Appl. No.: 14/240,011

(22) PCT Filed: Aug. 31, 2012

(86) PCT No.: PCT/EP2012/066962

§ 371 (c)(1),
(2), (4) Date: Apr. 3, 2014

(87) PCT Pub. No.: WO2013/030337

PCT Pub. Date: Mar. 7, 2013

(65) Prior Publication Data

US 2014/0216990 A1 Aug. 7, 2014

(30) Foreign Application Priority Data

Sep. 2, 2011 (DE) ..... 10 2011 112 214

(51) Int. Cl.
*B07C 5/00* (2006.01)
*B07C 5/36* (2006.01)

(52) U.S. Cl.
CPC .... *B07C 5/00* (2013.01); *B07C 5/36* (2013.01)

(58) Field of Classification Search
CPC ..... B07C 5/00; B07C 5/36
USPC ..... 209/552, 900
See application file for complete search history.

(56) References Cited

U.S. PATENT DOCUMENTS

| | | | | |
|---|---|---|---|---|
| 3,939,621 | A * | 2/1976 | Giori | 53/435 |
| 7,269,930 | B2 * | 9/2007 | Kahlisch et al. | 53/136.1 |
| 7,753,085 | B2 * | 7/2010 | Tribble et al. | 141/2 |
| 8,434,627 | B2 * | 5/2013 | Sporer | 209/534 |

FOREIGN PATENT DOCUMENTS

| | | |
|---|---|---|
| EP | 1 730 707 B1 | 12/2006 |
| WO | 02/10042 A1 | 2/2002 |

* cited by examiner

*Primary Examiner* — Terrell Matthews
(74) *Attorney, Agent, or Firm* — John A. Miller; Miller IP Group, PLC

(57) ABSTRACT

A method and a device for sorting identification objects is described, wherein identification objects are fed in a defined sequence, one after the other, to a first transfer position and inspected for defects. Identification objects identified as defect-free are transferred in the first transfer position by a first transfer arrangement to a transfer buffer, and identification objects identified as defective are transported away by a first transport arrangement. The defect-free identification objects are then fed to a first magazine, which is then transported to a second transfer position by a second transport arrangement. The first magazine is then aligned in a first position with a first buffer of a rotatable sorting arrangement, and the defect-free identification objects following the defective identification objects are transported by the first transport arrangement to the second transfer position and transferred by a second transfer arrangement to the first buffer.

22 Claims, 10 Drawing Sheets

METHOD AND DEVICE FOR SORTING IDENTIFICATION OBJECTS

TECHNICAL FIELD

A method for sorting identification objects and an apparatus for sorting identification objects are described, wherein a defined sequence of identification objects is also retained when defective identification objects in the defined sequence are replaced by defect-free identification objects. Identification objects comprise inter alia ID cards, smart cards and security documents, such as for example identity documents.

BACKGROUND

In the personalisation of identification objects, these objects are inspected for defects after the personalisation or after other processing steps. Personalised identification objects have, for example, identification numbers (e.g. insurance number, staff number, membership number, etc.) as well as the name and address of a person or a picture of the person associated with the corresponding data. In addition, identification objects may also have a chip or a magnetic strip, on which chip or magnetic strip person-specific data (e.g. age, address, department, access authorisation, account number, etc.) or other data are stored. For a plurality of identification objects, the data are collected in a so-called job.

Identification objects of a production lot which comprises all the identification objects of a job have a defined sequence after the personalisation. The identification objects are then also to be fed in this sequence to a magazine. If, however, in an inspection of the identification objects it is found that an identification object is defective, i.e. that either the chip and/or the magnetic strip has not been written on or has been incorrectly written on, or the number or name is not readable or the picture not adequately displayed, a new identification object which replaces the defective one is produced in a processing station upstream of the inspection. The defective identification object is discarded after the inspection.

The difficulty arising here is that the new identification object replacing the defective identification object is fed after the identification objects of the production lot. However, the new identification object has to occupy the position of the defective identification object in the sequence of the identification objects.

Therefore, new identification objects replacing defective identification objects have to be inserted into the defined sequence of the production lot in such a way that the identification objects can be transferred in the defined sequence to a magazine.

PRIOR ART

In conventional installations and procedures, new identification objects replacing defective identification objects have been inserted into a defined sequence of a production lot by temporarily storing, via a buffer, the identification objects following the defective identification object in the transport direction of the identification objects.

In this case, identification objects identified as defect-free are fed to a magazine and a following defective identification object is discarded. The identification objects following the defective identification object are fed to a buffer in which the identification objects are received one after the other. Subsequently, the new identification object replacing the defective identification object follows the production lot and is fed to the magazine. Then, the identification objects located in the buffer are transferred to a second buffer, so that these objects can be fed to the magazine in the defined sequence again.

The identification objects in this case are deposited on a conveying belt again according to the "FIFO" principle (first in first out). That is to say, the identification objects which are transferred to the buffer must necessarily be transferred to the second buffer in order to maintain the sequence of the identification objects on the conveying belt.

In the case of the apparatus described above and the procedure described above, the identification objects are removed individually from the conveying belt and deposited individually on the conveying belt again. This has a detrimental effect on the throughput of the apparatus and also results in a high defect frequency and defect susceptibility. Moreover, the feeding of the identification objects to the magazine is performed via the conveying belt.

Such a sorting device has an increased space requirement owing to the different drives of the buffers, and the buffers themselves. Moreover, a complex control arises for such a sorting device, since the identification objects are transferred individually.

Furthermore, such a sorting device has a complex construction.

In addition, such a sorting device also provides only a low throughput owing to the arrangement of the buffers and the temporary storage of identification objects.

The prior art further discloses apparatuses and methods for processing value documents, in which defective value documents can be replaced. Thus, the document EP 1 730 707 B1 discloses a system for quality inspection of value documents. The system comprises storage compartments for stacked depositing of the inspected value documents. In addition, means for subsequent processing of defective value documents are provided. The means for subsequent processing can insert replacement documents into the conveying stream, mark inspected value documents or individualise non-individualised value documents. The means can further comprise a control device which generates data on the position of replacement documents to be inserted into the stack.

Further devices and method for processing value documents, in which defective value documents can be exchanged, are described in the documents DE 10 2008 011 664 A1, DE 2502987 and EP 1 607 355 B1.

Underlying Object

It is therefore the object to provide a method and an apparatus which enable quick sorting of identification objects in a defined sequence, wherein more than one identification object and identification objects can be sorted in stacks and the outlay involved with the sorting is considerably reduced.

Solution

A method, achieving this object, for sorting identification objects which are transported in a defined sequence on a first transport device comprises several steps. Firstly, the identification objects are fed one after the other to a first transfer position, wherein the identification objects are inspected for defects in the first transfer position or before reaching the first transfer position. Identification objects identified as defect-free are transferred in the first transfer position by means of a first transfer device to a transfer buffer. Identification objects identified as defective are transported by means of the first transport device to a further device. The defect-free identification objects located in the transfer buffer are fed to a first magazine arranged relative to the transfer buffer. Subsequently, the first magazine is transported by means of a second transport device to a second transfer position, so that the first magazine is aligned in a first position with a first buffer of a rotatable sorting device. Defect-free identification objects following the defective identification object are transported by means of the first transport device to the second transfer position and transferred by means of a second transfer device to the first buffer. The rotatable sorting device is rotated into a further position. A new, defect-free identification object which replaces the defective identification object, wherein the new identification object is fed after the following identification objects by means of the first transport device to the second transfer position, is transferred to a second buffer, located in the further position, of the rotatable sorting device. This new identification object is subsequently transferred from the second buffer to the first magazine. Thereafter, the rotatable sorting device is rotated back into the first position, so that the identification objects are transferred from the first buffer by means of the second transfer device to the first magazine.

With this method, it is possible to maintain the sequence of a production lot, even if a plurality of identification objects are defective and have to be replaced by new identification objects. Moreover, identification objects can be transferred to the transfer buffer and the buffers of the sorting device in stacks.

The identification objects can also be supplied in stacks directly to the first magazine, so that further sorting as in the prior art is dispensed with. The identification objects can be transferred directly and do not have to be deposited on a conveying belt again.

With the method proposed here, a high throughput can be achieved, since inter alia no waiting times arise for further sorting operations.

In a development of the method, the identification objects are transferred from the transfer buffer to the first magazine when all the identification objects of a production lot are present in the transfer buffer and/or when the transfer buffer is full.

Moreover, a second magazine can be brought into the first transfer position when the first magazine is located in the second transfer position. In this case, on the one hand the sorting of a second production lot can be started and on the other hand a sorting operation for a second production lot can be prepared.

Furthermore, on the first transport device further identification objects of a further production lot can be fed to the transfer buffer. If the identification objects of a first production lot are located in the buffers of the rotatable sorting device and no further new identification objects for the first production lot are fed to the buffers of the sorting device, a sorting operation for a second production lot can be carried out.

Moreover, the buffers of the rotatable sorting device can receive identification objects of the second production lot, while a sorting operation for a first production lot is still being carried out. The identification objects of the second production lot are not fed to a second magazine until the first magazine is full, i.e. all the identification objects of the first production lot have been received therein, and the second magazine has been transferred to the second transfer position.

In the method, a plurality of new identification objects can also be produced, which correspond to a plurality of defective identification objects.

In addition, the new identification objects can be fed to different buffers or to a buffer of the rotatable sorting device. Depending on the sequence of the defective identification objects, the new identification objects are each fed individually to a separate buffer or in stacks to one buffer.

In a further method, the new identification objects and the defect-free identification objects can be fed successively to buffers of the rotatable sorting device, so that a defined sequence of the identification objects results according to the sequence of the buffers. The sequence of the buffers determines the sequence of the identification objects, the buffers each having to be rotated by only one position further upon a transfer of the identification objects from the buffers.

Further, after the identification of a defective identification object in a processing station upstream in the transport direction of the identification objects, a new identification object replacing the defective identification object can be produced.

The sequence of the transfer of the identification objects to the buffers of the rotatable sorting device can thus also define the sequence of the identification objects in the magazine.

The defective identification objects can further be fed to a collecting device for defective identification objects.

Furthermore, security features of the identification objects can be inspected in the first transfer position or before the first transfer position is reached.

In this case, it is possible for a multiplicity of identification objects to be received in the buffers of the rotatable sorting device and/or the transfer buffer. Besides the buffers of the rotatable sorting device, it is also possible for the transfer buffer to receive a multiplicity of identification objects. The buffers and the transfer buffer can, for example, be adapted to receive a number of identification objects corresponding to the production lot.

In addition, a multiplicity of identification objects can be fed simultaneously from the first and/or second transfer device to the buffers of the sorting device, the transfer buffer and/or the first magazine. Thus, for example, a number of identification objects corresponding to the production lot can be transferred simultaneously from the transfer buffer or from the buffers of the rotatable sorting device to the magazine.

An apparatus, achieving the above-mentioned object, for sorting identification objects comprises a first transport device for transporting the identification objects one after the other in a defined sequence to a first and a second transfer position. The apparatus further comprises a transfer buffer which is arranged in the first transfer position and is arranged relative to the transport device and a first magazine, and an identification device for identifying defect-free and defective identification objects which is arranged in the first transfer position or upstream of the first transfer position in the transport direction of the identification objects. The apparatus additionally has a second transport device for transporting the at least one first magazine, receiving the security objects, from the first transfer position to the second transfer position, and two transfer devices arranged relative to the first transport device. The first transfer device is arranged in the first transfer position and the second transfer device is arranged in the second transfer position. The first transfer device is adapted to feed identification objects identified as defect-free from the first transport device to the transfer buffer and to the first magazine. Identification objects identified as defective are transported by means of the first transport device to at least one further device. The apparatus furthermore has a rotatable sorting device which has a multiplicity of buffers for at least one identification object. The second transfer device is adapted to feed identification objects from the first transport device to the buffers of the rotatable sorting device and identification objects from the buffers to the first magazine. The rotatable sorting device is adapted to move the buffers relative to the first transport device and, depending on the sequence of the identification objects, to rotate the rotatable sorting device from a position of a buffer relative to the second transfer position, in which the magazine is aligned with one of the buffers, into a further position. As a result, the identification objects are fed to the first magazine in a sequence corresponding to the defined sequence.

The apparatus has a simple construction and offers the possibility of sorting a multiplicity of new identification objects as well as defect-free identification objects without long waiting times. The simple construction also results in a reduction of the assembly and commissioning time for such an apparatus. By transferring the identification objects to the buffers and from the buffers to the magazine, further sorting of temporarily stored identification objects is dispensed with.

Furthermore, the rotatable sorting device has the advantage that the identification objects temporarily stored in the buffers can be brought quickly to the second transfer position, irrespective of the position relative to the second transfer position.

The control of the rotatable sorting device can, moreover, be performed via only one drive, for example a servo drive. In the case of such an apparatus, the defect frequency and defect susceptibility are also reduced, since not every identification object has to be sorted individually.

A second magazine can be brought into the first transfer position by means of the second transport device when the first magazine is located in the first transfer position and the identification device can be adapted to inspect security features of the identification objects.

Further, the at least one device can comprise a collecting device for defective identification objects and the rotatable sorting device can be a rotary table, on which a multiplicity of buffers for identification objects are arranged at regular spacings.

In a further configuration of the apparatus, the latter has a processing station, upstream of the apparatus in the transport direction of the identification objects, for producing new identification objects replacing defective identification objects, wherein all the identification objects can also be personalised in the processing station.

The buffers of the sorting device and/or of the transfer buffer can be adapted to receive a multiplicity of identification objects and the first and/or second transfer device is/are adapted to feed simultaneously a multiplicity of identification objects to the buffers of the sorting device, the transfer buffer and/or the first magazine. The capacity of the transfer buffer, of the buffers of the rotatable sorting device and of the first magazine can be chosen in dependence on the thickness of the identification objects. Moreover, the transfer buffer, the buffers of the rotatable sorting device and the first magazine can be chosen in accordance with the respective identification objects used or to be sorted.

BRIEF DESCRIPTION OF THE DRAWINGS

Further aims, features, advantages and possible applications emerge from the following description of embodiments which are not to be understood as limiting, with reference to the associated drawings. All of the features described and/or pictorially represented constitute, by themselves or in any combination, the subject matter disclosed here, also irrespective of their grouping in the claims or those to which the latter refer back. The dimensions and proportions of the components shown in the figures are not necessarily to scale here; they may deviate from those illustrated, in embodiments to be imple-mented.

FIGS. 1 to 9 show different method steps in a schematically represented apparatus for sorting identification objects.

DETAILED DESCRIPTION OF THE EMBODIMENTS

An apparatus for sorting cards is described below, where the cards are to be regarded merely as an example of identification objects and the apparatus for sorting which is shown can nevertheless be used for identification objects of any kind.

Figure 1:
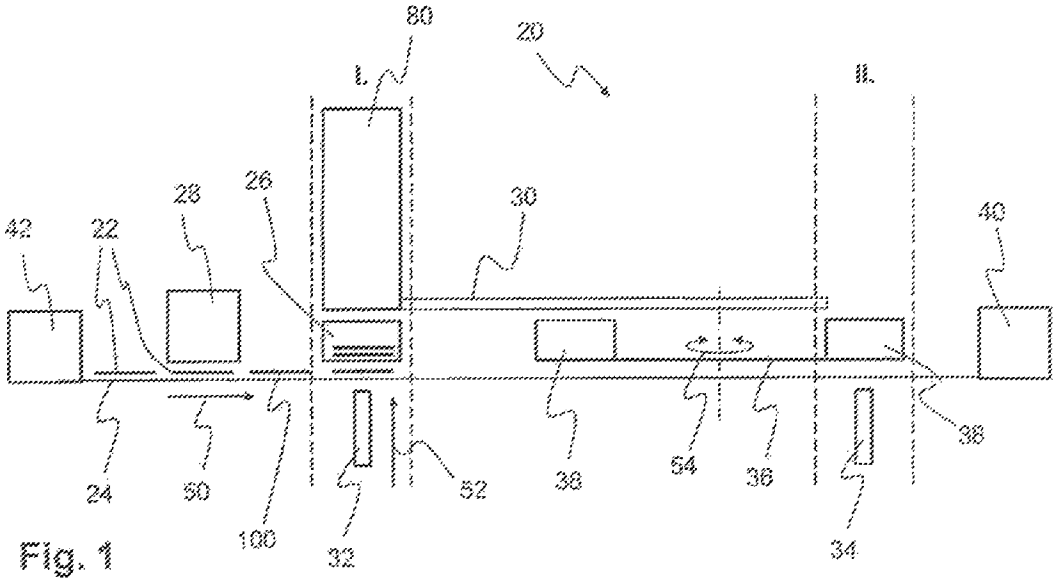

FIG. 1 shows schematically a side view of an apparatus for sorting cards, this apparatus being referred to as sorting apparatus 20 below. The sorting apparatus 20 of FIG. 1 has a processing station 42, in which cards 22 are personalised. However, it is also possible for other processing steps to be performed in the processing station 42. The cards 22 are moved from the processing station 42 via a first transport device 24 in the processing direction, represented by arrow 50. The cards 22 then arrive at a first transfer position I., an identification device 28 being arranged between the processing station 42 and the first transfer station I. Means for inspecting or testing the cards 22 are con-tained in the identification device 28. The identification device 28 outputs a signal con-taining information about the state of a card 22. That is to say, in the identification device 28 it is detected whether a tested card 22 is defect-free or defective.

In the first transfer position I., a first transfer device 32 is located below the first transport device 24. A transfer buffer 26 is located above the first transport device 24 in the first transfer position I. Further, a first magazine 80 is located in the first transfer position I. above the transfer buffer 26. The first transfer device 32 is adapted to transfer cards 22 from the first transport device 24 to the transfer buffer 26 and from the transfer buffer 26 to the first magazine 80. Arrow 52 shows the direction in which the cards 22 are transferred to the transfer buffer 26 and to the first magazine 80. The cards 22 can be transferred individually or in stacks.

The first transport device 24 extends further to a second transfer position II. In the second transfer position II., a second transfer device 34 is arranged below the first transport device 24. A rotatable sorting device 36 is arranged above the first transport device 24 between the first transfer position I. and the second transfer position II., the rotatable sorting device 36 partially projecting into the second transfer position II. A multiplicity of buffers 38 are arranged on the rotatable sorting device 36, only two buffers 38 being shown in FIG. 1. The rotatable sorting device 36 can, as represented as by the double-headed arrow 54, be rotated both clockwise and anticlockwise in the plane defined by the rotatable sorting device 36. In FIG. 1, one buffer 38 of the rotatable sorting device 36 is located in the second transfer position II. The rotatable sorting device 36 can be configured and controlled in such a way that it is always rotated so far that a buffer 38 is located in the second transfer position II.

A second transport device 30 is arranged between the first transfer position I. and the second transfer position II. The second transport device 30 serves to bring the first magazine 80 from the first transfer position I. to the second transfer position II.

The second transfer device 34 is adapted to transfer cards 22, 120 to the buffers 38. Furthermore, the second transfer device 34 is adapted to transfer cards 22, 120 from the buffers 38 to the first magazine 80 in the second transfer position II.

The first transport device 24 extends after the second transfer position II. to a collecting device 40. Defective cards 100 are received in the collecting device 40. The collecting device 40 can be formed in this case as a magazine for bad cards or as a receptacle, in which the cards 100 are collected in a disordered and unsorted manner.

The sorting apparatus 20 furthermore has other components and constituent parts, which are not shown in the figures for reasons of clarity. In addition, the sorting apparatus 20 has a control which is adapted to control the individual devices. The sorting apparatus 20 also comprises a drive for the first transport device 24, a drive for the second transport device 30, a drive for the rotatable sorting device 36 and drives for the first and second transfer device 32 and 34. The first and second transfer device 32, 34 are formed as pneumatic transfer devices in the example shown here. However, other configurations, for example hydraulic transfer devices 32, 34 or transfer devices 32, 34 having an electric motor, are likewise conceivable.

A method for sorting cards 22 is described below with reference to FIGS. 1 to 9.

Cards 22 are personalised in the processing station 42. The cards 22 are guided in a defined sequence past an identification device 28 in the transport direction (arrow 50) via the first transport device 24. During this, the identification device 28 inspects the personalised cards 22. The cards 22 are then transported by means of the first transport device 24 further to the first transfer position I.

Cards 22 identified as defect-free are transferred via the first transfer device 32 in the first transfer position I. to the transfer buffer 26. During this, the first magazine 80 is located above the transfer buffer 26 in the first transfer station I.

Figure 2:
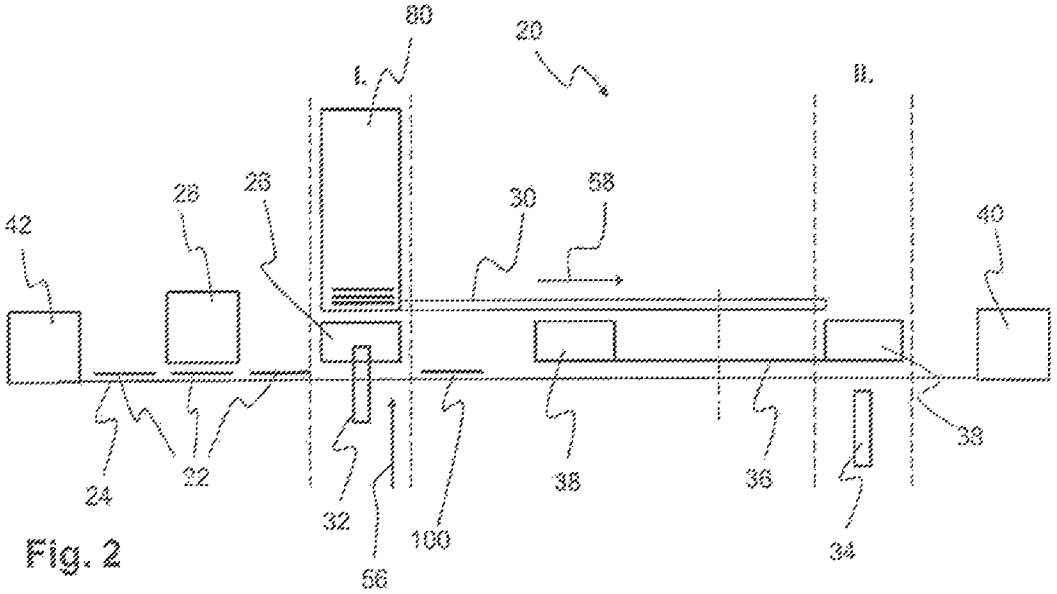
Figure 3:
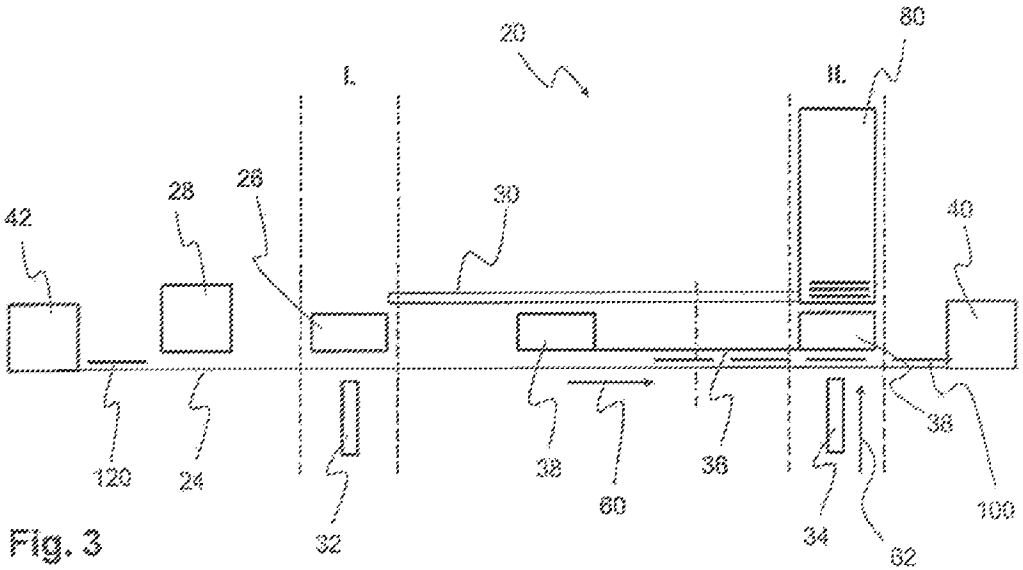
Figure 4:
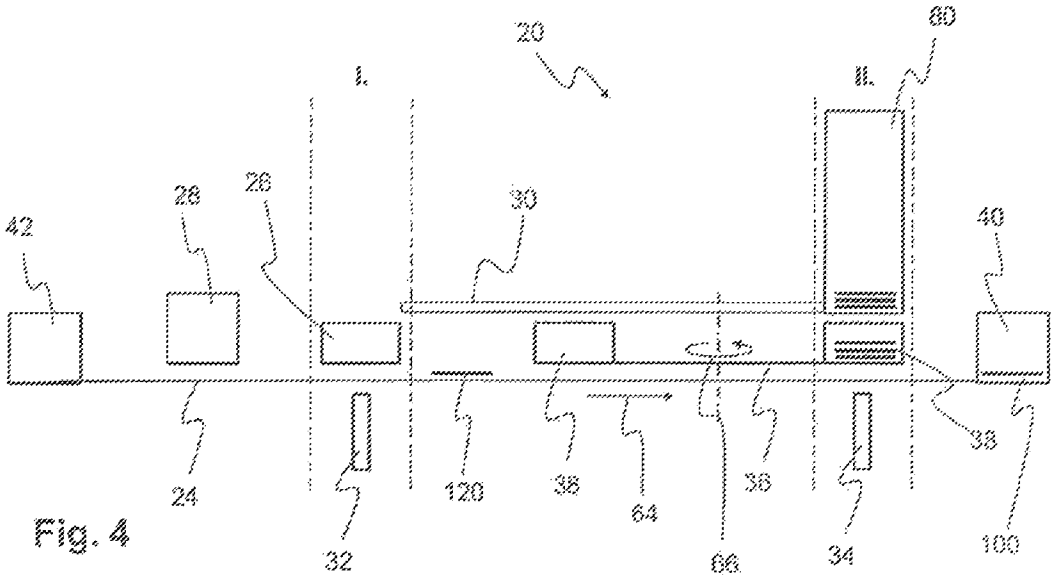
Figure 5:
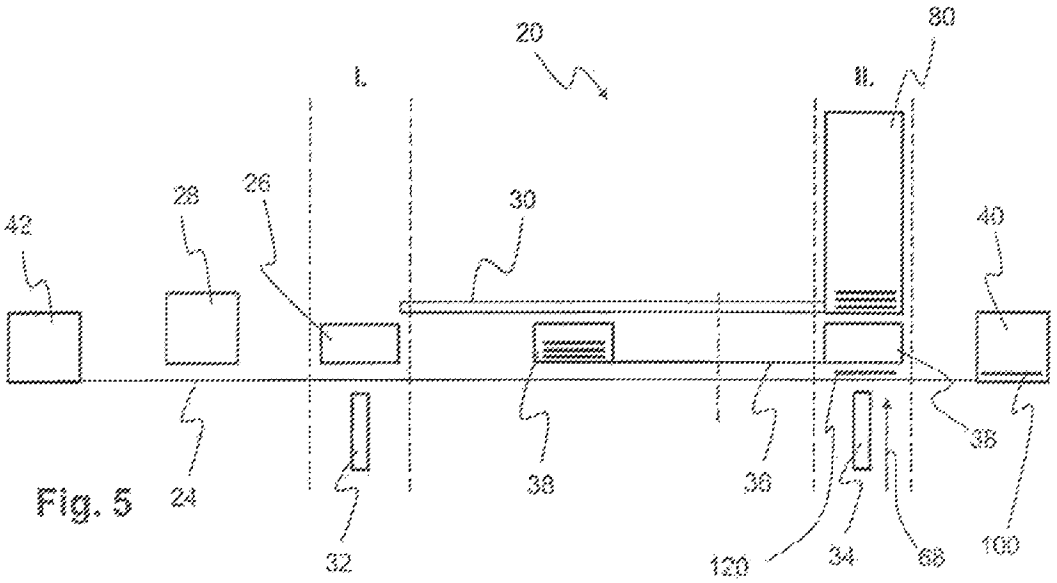

If a card 100 has been identified as defective in the identification device 28, the defect-free cards 22 which are located in front of the defective card 100 in the transport direction of the cards and in the sequence of the cards are transferred to the transfer buffer 26 and subsequently transferred from the transfer buffer 26 by means of the first transfer device 32 to the first magazine 80 (see arrow 56 in FIG. 2).

The defective card 100 is transported by means of the first transport device 24 further in the direction of the collecting device 40. After the defect-free cards 22 have been transferred to the first magazine 80, the first magazine 80 with the defect-free cards 22 is brought by means of the second transport device 30 to the second transfer position II. (arrow 58 in FIG. 2). The cards 22 following the defective card 100 are tested by the identification device 28 and after the identification are transported as defect-free cards 22 by means of the first transport device 24 further in the transport direction to the second transfer position II.

After the defective card 100 has passed the second transfer position II., it is transferred to the collecting device 40. The defect-free cards 22 following the defective card 100 are brought in the transport direction (arrow 60 in FIG. 3) by means of the first transport device 24 to the second transfer position II. There, these cards 22 are transferred via the second transfer device 34 to a first buffer 38 of the rotatable sorting device 36 (arrow 62).

Subsequent to the identification of a defective card 100, a new card 120 is produced in the processing station 42 or a card 120 is personalised, corresponding to the defective card 100. This card 120 is guided in the transport direction (arrow 60) by means of the first transport device 24 past the identification device 28 and likewise tested by the identification device 28. During this, the testing of the cards 22, 100, 120 by means of the identification device 28 can be performed in such a way that the first transport device 24 is stopped or is continuously moved on.

The defect-free new card 120 is guided past the first transfer position I. and moved by means of the first transport device 24 in the transport direction (arrow 64 in FIG. 4) to the second transfer position II. After the cards 22 have been transferred to the first buffer 38, the rotatable sorting device 36 is rotated by one position further. In the example shown here, the rotatable sorting device 36 is rotated in the direction of the arrow 66 (FIG. 4) by 180°. A further buffer 38 of the rotatable sorting device 36, in which no cards have been received, is then located in the second transfer position II.

In the meantime, the defective card 100 is received in the collecting container 40.

Figure 6:
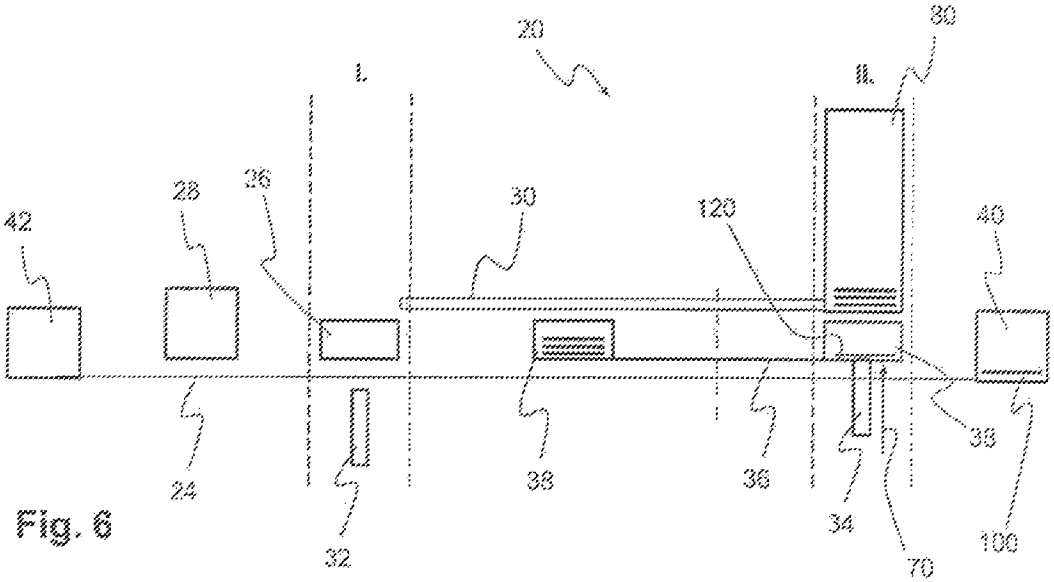
Figure 7:
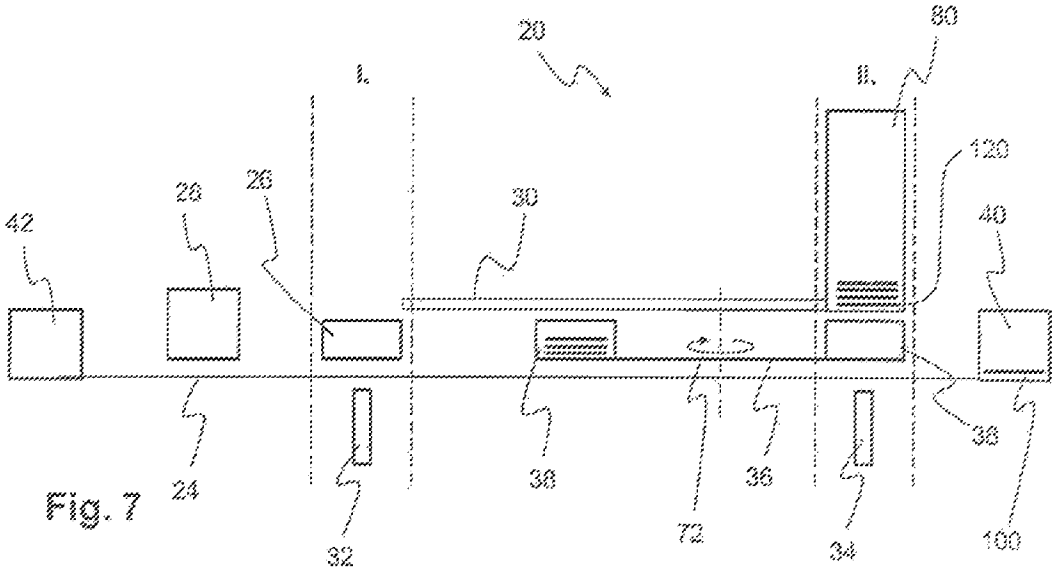
Figure 6:
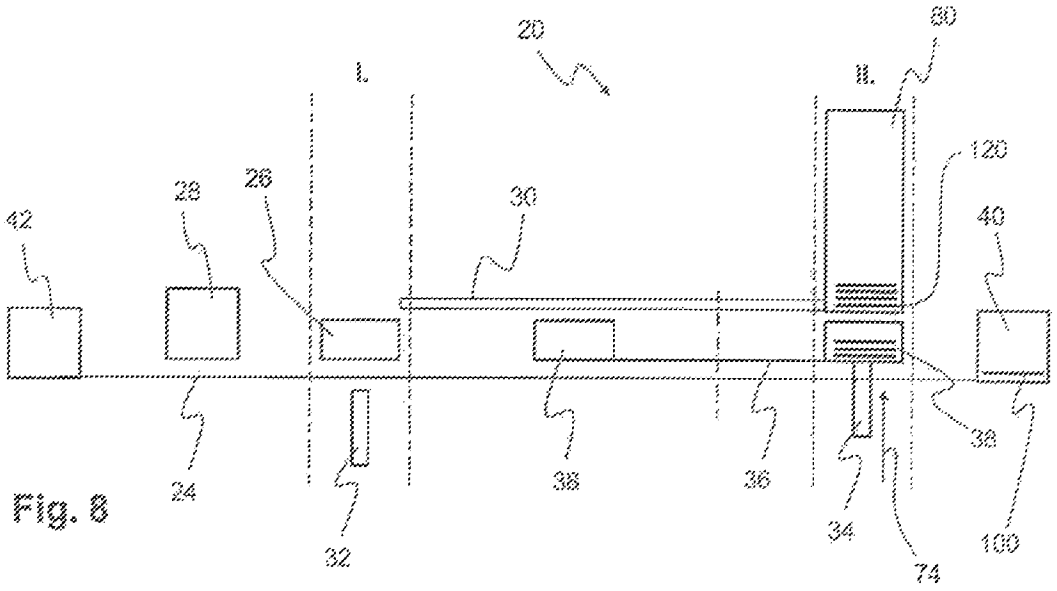

When the new card 120 has arrived at the second transfer position II., it is transferred by means of the second transfer device 34 to the further buffer 38 (arrow 68 in FIG. 5) and from the further buffer 38 to the first magazine 80 (arrow 70 in FIG. 6). As a result, the new card 120 is located in the first magazine 80 at the position corresponding to the defective card 100.

After the new card 120 has been transferred to the first magazine 80, the rotatable sorting device 36 is rotated back again (arrow 72 in FIG. 7) in order to bring the first buffer 38 with the cards 22 to the second transfer position II. again.

When the first buffer 38 is located in the second transfer position II., the cards 22 are transferred from the first buffer 38 by means of the second transfer device 34 to the first magazine 80 (arrow 74 in FIG. 8). During this, the transfer is performed in such a way that the original sequence of the cards is retained in spite of a new card 120 replacing a defective card 100. This is achieved by virtue of the fact that, after the cards have been transferred to the transfer buffer 26 and the buffers 38 of the rotatable sorting device 36, during which the cards are deposited in the intended sequence therein (i.e. the topmost card corresponds to the first card in the sequence), all that is required is for the cards to be transferred or "pushed" upwards into the first magazine 80.

Figure 9:
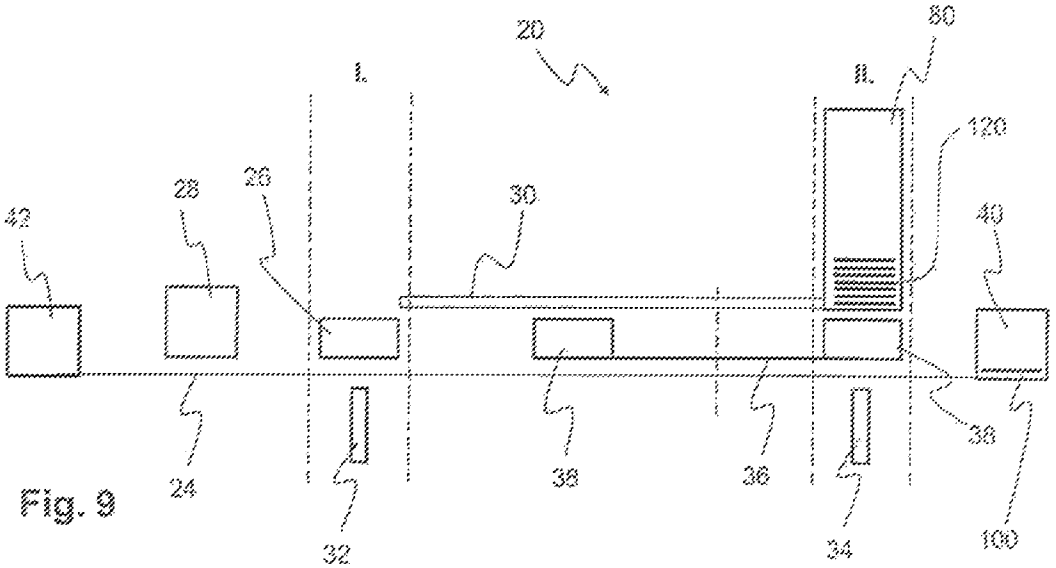

In FIG. 9 the sorting apparatus 20 is represented schematically after one sorting operation for a production lot. The defective card 100 is located in the collecting device 40 for bad cards, and the defect-free cards 22, 120 are located in the first magazine 80 in the defined sequence.

Subsequently, the collecting device 40 can be emptied or removed from the sorting apparatus 20. The first magazine 80 can likewise be removed and transferred to further processing stations or used in some other way.

Figure 10:
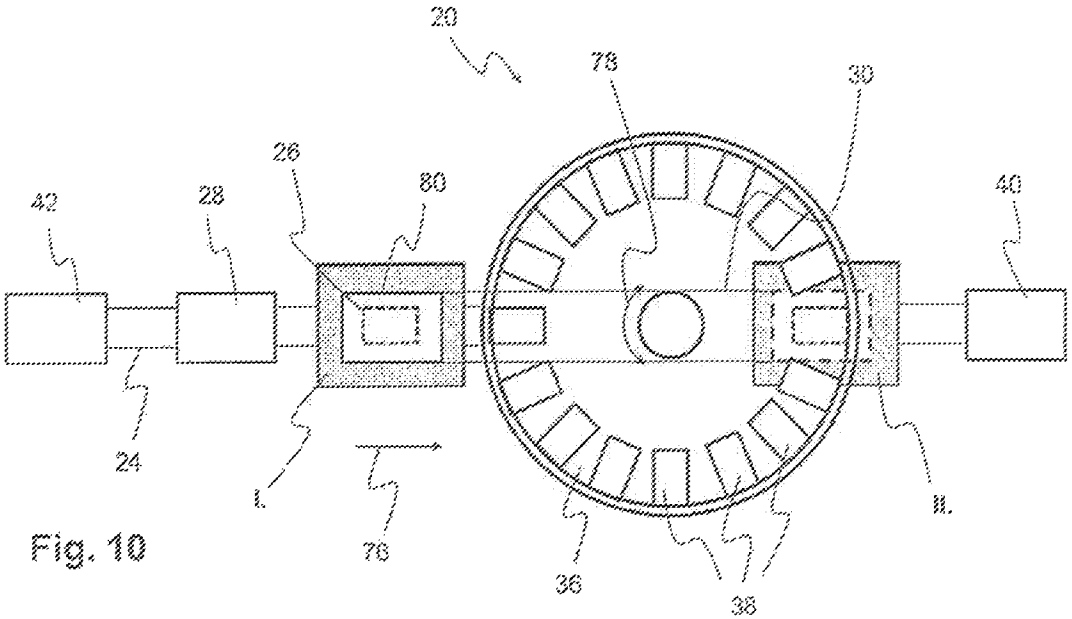
FIG. 10 shows schematically a plan view of an apparatus for sorting identification objects.

FIG. 10 shows schematically a plan view of a sorting apparatus 20 for sorting cards. The sorting apparatus has a processing station 42, an identification device 28, a transfer buffer 26, a rotatable sorting device 36 having a multiplicity of buffers 38, and a collecting device 40. A first transport device 24 extends from the processing station 42 to the collecting device 40 via the identification device 28, the transfer buffer 26 and the rotatable sensor device 36 having the multiplicity of buffers 38. The transfer buffer 26 is located in a first transfer position I. One of the multiplicity of buffers 38 is located in the second transfer position II. In addition, the sorting apparatus 20 has a second transport device 30 which is adapted to transport a first magazine 80 located in the first transfer position I. to the second transfer position II. The position of the first magazine 80 in the second transfer position II. is indicated in FIG. 10 by the dashed line.

The rotatable sorting device 36 can be rotated both clockwise and anticlockwise, as indicated by the double-headed arrow 78. Cards (not shown in FIG. 10) can be transported in the transport direction (arrow 76) along the different devices. In addition, the second transport device is adapted to move the first magazine 80 in the direction of the arrow 76.

The sorting apparatus 20 of FIG. 10 furthermore also has a first and second transfer device 32 and 34, the transfer devices 32, 34 not being shown in FIG. 10. The first transfer device 32 is located in the first transfer position I. and the second transfer device 34 is located in the second transfer position II. Moreover, the sorting apparatus 20 of FIG. 10 has further constituent parts and components and also a control, these not being shown for reasons of clarity. The control of the sorting apparatus 20 is adapted to control the sorting apparatus 20. The sorting apparatus 20 of FIG. 10 further comprises a drive for the first transport device 24, a drive for the second transport device 30, a drive for the rotatable sorting device 36 and drives for the first and second transfer device 32 and 34. The first and second transfer device 32, 34 can be formed as pneumatic transfer devices. Other configurations are, however, also conceivable, such as for example hydraulic transfer devices 32, 34 and transfer devices 32, 34 having an electric motor, which in turn can enable a linear drive.

The devices of the sorting apparatus 20 of FIG. 10 correspond in their configuration and function substantially to those of FIGS. 1 to 9.

However, the rotatable sorting device 36 has 16 buffers 38. By virtue of the multiplicity of buffers 38, a sorting operation is achieved without long waiting times even when there are a plurality of defective cards 100. In contrast to known sorting apparatuses in which generally the number of cards which can be exchanged is limited and the cards can be transferred only individually, sorting of cards is performed by the sorting apparatus 20 in stacks and without additional sorting of temporarily stored cards.

In the case of the sorting apparatus 20 shown in FIG. 10, cards 22 (not shown in FIG. 10) are transported from the processing station 42 via the first transport device 24 to the identification device 28 and from there to the first transfer position I. Cards 100 identified as defective by the identification device 28 are transported by means of the first transporting device 24 to the collecting device 40. Defect-free cards 22 are brought by means of the first transport device 24 to the first transfer position I. and there by the first transfer device 32 to the transfer buffer 26.

If a card is identified as defective by the identification device 28, the cards 22 preceding the defective card 100 are transferred to the transfer buffer 26 and from there to the first magazine 80. The cards 22 are transferred by means of the first transfer device 32 individually from the first transport device 24 to the transfer buffer 26 and from the transfer buffer 26 to the first magazine 80 as a stack. That is to say, the sequence of the cards 22 is retained and the cards 22 are transferred in one transfer operation.

The defective card 100 is then fed by means of the first transport device 24 to the collecting device 40. After the defect-free cards 22 have been transferred from the transfer buffer 26 to the first magazine 80, the first magazine 80 is transported by means of the second transport device 30 to the second transfer position II. A new card 120 replacing the defective card 100 is then produced in the processing station 42, and is transported subsequent to the cards of the production lot on the first transport device 24 to the second transfer position II.

The defect-free cards 22 of the production lot which follow the defective card 100 are brought to the second transfer position II., from where they are transferred via the second transfer device 34 to a first buffer 38 of the rotatable sorting device 36 individually by the first transport device 24 to the first buffer 38 in the sequence in which they are fed on the first transport device 24.

If the production lot contains only one defective card 100, the rotatable sorting device 36 is rotated by one position further, after the defect-free cards 22 of the production lot which follow the defective card 100 have been transferred to the first buffer 38. After the cards 22 have been transferred to the first buffer 38 and the rotatable sorting device 36 has been rotated by one position further, the new card 120 is transferred by means of the second transfer device 34, when the card 120 has reached the second transfer position II., to a further buffer 38 of the rotatable sorting device 36 which is located in the second transfer position II.

Subsequently, the new card 120 is transferred to the first magazine 80 by means of the second transfer device 34 and thereafter the rotatable sorting device 36 is rotated back again, so that the first buffer 38 with the defect-free cards 22 is located in the second transfer position II. Then, the cards 22 are transferred from the first buffer 38 via the second transfer device 34 to the first magazine 80.

If a plurality of cards are identified as defective, firstly the defect-free cards 22 in the first transfer position I. are transferred until a card has been identified as defective. The defect-free cards 22 are then fed in the first transfer position I. via the transfer buffer 26 to the first magazine 80. Subsequently, the defect-free cards 22 following the defective card 100 are fed to a first buffer 38 of the rotatable sorting device 36 in the second transfer position II., until a further defective card 100 has been identified. The further defective card 100 is then fed by means of the first transport device 24 to the collecting device 40. The cards 22 following the further defective card 100 are fed to a further buffer 38 of the rotatable sorting device 36. This is performed only after the rotatable sorting device 36 has been rotated into a further position and after the defect-free cards 22, which have been brought on the first transport device 24 to the second transfer position II. before the further defective card 100, have been transferred to the first buffer 38.

When the original, defect-free cards 22 of the production lot have been transferred to the first and the further buffer 38, two new cards 120 replacing the defective cards 100 are brought to the second transfer position II. During this, the rotatable sorting device 36 is rotated such that another further free buffer 38 of the rotatable sorting device 36 is located in the second transfer position II. The first new card 120 is then transferred by the first transport device 24 via the further free buffer 38 by means of the second transfer device 34 to the first magazine 80 and thereafter the rotatable sorting device 36 is rotated in such a way that the defect-free cards 22 located in the first buffer 38, and the first buffer 38, are located in the second transfer position II. Then, the cards 22 located in the first buffer 38 are transferred by means of the second transfer device 34 to the first magazine 80. Subsequently, the rotatable sorting device 36 is rotated again into a position in which a free buffer 38 is located in the second transfer position II. Then, the second new card 120 is transferred via the free buffer 38 by means of the second transfer device 34 to the first magazine 80. Thereafter, the rotatable sorting device 36 is rotated such that the further buffer 38 with the defect-free cards 22 is located in the second transfer position II. The defect-free cards 22 are then transferred from the further buffer 38 by means of the second transfer device 34 to the first magazine 80. If a production lot contains further defective cards 100, the defect-free cards 22 between the defective cards 100 are each transferred to a buffer 38 of the rotatable sorting device 36. The transfer of the defect-free cards 22 to the different buffers 38 and of the new cards 120 to the first magazine 80 is then performed analogously to the method described above.

The number of buffer 38 can be set on the basis of known, statistically determined rejection numbers according to the size of the production lot. Consequently, the number of buffers 38 can be varied according to the size of the production lot, where either the rotatable sorting device 36 in a sorting apparatus 20 can be exchanged or individual buffers 38 of the rotatable sorting device 20 can be removed or additionally arranged. The size of the transfer buffer 26 and of the buffers 38 is, moreover, determined by the thickness of the cards. The control of the sorting apparatus 20 is then adjusted accordingly.

The rotatable sorting device 36 can, however, also have a different number of buffers 38. As an alternative to changing the number of buffers 38 of the rotatable sorting device 36, it is possible to achieve an increase of the available buffers 38 by two or more rotatable sorting devices 36 arranged one behind the other in the transport direction of the cards. In this case, the sorting apparatus then has at least one third transfer position III. in addition to the first and second transfer position I. and II. Accordingly, the sorting apparatus also has at least three transfer devices. The second transport device of such a sorting apparatus extends from the first transfer position I. up to the third or last transfer position III.

Owing to the rotatable sorting device, it is possible in the case of a sorting apparatus having a plurality of sorting devices, to sort cards of a plurality of production lots—also in a disorded manner, i.e. in no defined sequence. In this case, a plurality of magazines are brought into the first, the second and further transfer positions. The cards are temporarily stored in the buffers of the rotatable sorting devices and are fed by the respective transfer devices in a defined sequence to the respective magazines by rotating the rotatable sorting devices in a corresponding manner.

In a further embodiment (not shown), the first transfer position I. is located in the cen-tre of the rotatable sorting device 36. In this case, the rotatable sorting device 36 has centrally an opening which is large enough for the cards or identification objects to be able to be transferred to the transfer buffer 26 and the first magazine 80. In the case of such a sorting apparatus 20, the rotatable sorting device 36 can be at least partially supported at its outer edge and driven via the edge. In the case of such a configuration, the distance which the first magazine 80 has to cover from the first transfer position I. to the second transfer position II. is reduced. This has a further beneficial effect on the duration of a sorting operation and the throughput of the sorting apparatus 20, as well as the installation space.

The invention claimed is:

1. A method for sorting identification objects which are transported in a defined sequence on a first transport device, comprising:

feeding the identification objects one after the other to a first transfer position, wherein the identification objects are inspected for defects in the first transfer position or before reaching the first transfer position, and identification objects identified as defect-free are transferred in the first transfer position by a first transfer device to a transfer buffer, and the identification objects identified as defective are transported by the first transport device to another device;

feeding the defect-free identification objects located in the transfer buffer to a first magazine arranged relative to the transfer buffer and subsequently the first magazine is transported by a second transport device to a second transfer position, so that the first magazine is aligned in a first position with a first buffer of a rotatable sorting device, wherein the defect-free identification objects following the defective identification object are transported by the first transport device to the second transfer position and transferred by a second transfer device to the first buffer; and rotating the rotatable sorting device into a further position, and a new, defect-free identification object which replaces the defective identification object, wherein the new identification object is fed after the following identification objects by the first transport device to the second transfer position, is transferred to a second buffer, located in the further position, of the rotatable sorting device and is subsequently transferred from the second buffer to the first magazine, and thereafter the rotatable sorting device is rotated back into the first position, so that the identification objects are transferred from the first buffer by the second transfer device to the first magazine.

2. The method according to claim 1, wherein the identification objects are transferred from the transfer buffer to the first magazine when all the identification objects of a production lot are present in the transfer buffer and/or when the transfer buffer is full.

3. The method according to claim 1, wherein a second magazine is brought into the first transfer position when the first magazine is located in the second transfer position.

4. The method according to claim 3, wherein on the first transport device further identification objects of a further production lot are fed to the transfer buffer.

5. The method according to claim 1, wherein a plurality of new identification objects are produced, which replace a plurality of defective identification objects.

6. The method according to claim 5, wherein the new identification objects are fed to different buffers or to a buffer of the rotatable sorting device.

7. The method according to claim 5, wherein the new identification objects and the defect-free identification objects are fed successively to buffers of the rotatable sorting device, so that a defined sequence of the identification objects results according to the sequence of the buffers.

8. The method according to claim 1, wherein, after the identification of a defective identification object in a processing station upstream in the transport direction of the identification objects, a new identification object replacing the defective identification object is produced.

9. The method according to claim 6, wherein the sequence of the transfer of the identification objects to the buffers of the rotatable sorting device defines the sequence of the identification objects in the magazine.

10. The method according to claim 1, wherein defective identification objects are fed to a collecting device for defective identification objects.

11. The method according to claim 1, wherein security features of the identification objects are inspected in the first transfer position or before the first transfer position is reached.

12. The method according to claim 1, wherein a multiplicity of identification objects are received in the buffers of the rotatable sorting device and/or the transfer buffer.

13. The method according to claim 1, wherein a multiplicity of identification objects are fed simultaneously from the first and/or second transfer device to the buffers of the rotatable sorting device, the transfer buffer and/or the first magazine.

14. An apparatus for sorting identification objects, comprising:

a first transport device for transporting the identification objects one after the other in a defined sequence to a first and a second transfer position, a transfer buffer which is arranged in the first transfer position and is arranged relative to the first transport device and a first magazine, an identification device for identifying defect-free and defective identification objects which is arranged in the first transfer position or upstream of the first transfer position in the transport direction of the identification objects, a second transport device for transporting the at least one first magazine, receiving the identification objects, from the first transfer position to the second transfer position, two transfer devices arranged relative to the first transport device, wherein the first transfer device is arranged in the first transfer position and the second transfer device is arranged in the second transfer position, and wherein the first transfer device is adapted to feed identification objects identified as defect-free from the first transport device to the transfer buffer and to the first magazine, and wherein identification objects identified as defective are transported by means of the first transport device to at least one further device, a rotatable sorting device which has a multiplicity of buffers for at least one identification object, wherein the second transfer device is adapted to feed identification objects from the first transport device to the buffers of the rotatable sorting device and identification objects from the buffers to the first magazine, and wherein the rotatable sorting device is adapted to move the buffers relative to the first transport device and, depending on the sequence of the identification objects, to rotate the rotatable sorting device from a position of a buffer relative to the second transfer position, in which the first magazine is aligned with one of the buffers, into a further position, so that the identification objects are fed to the first magazine in a sequence corresponding to the defined sequence.

15. The apparatus according to claim 14, wherein a second magazine can be brought into the first transfer position by the second transport device when the first magazine is located in the second transfer position.

16. The apparatus according to claim 14, wherein the identification device is adapted to inspect security features of the identification objects.

17. The apparatus according to claim 14, wherein the at least one device comprises a collecting device for defective identification objects.

18. The apparatus according to claim 14, wherein the rotatable sorting device is a rotary table, on which a multiplicity of buffers for identification objects are arranged at regular spacings.

19. The apparatus according to claim 14, further comprising a processing station, upstream of the device in the transport direction of the identification objects, for producing new identification objects replacing defective identification objects.

20. The apparatus according to claim 19, wherein the identification objects are personalised in the processing station.

21. The apparatus according to claim 14, wherein the buffers of the rotatable sorting device and/or of the transfer buffer are adapted to receive a multiplicity of identification objects.

22. The apparatus according to claim 14, wherein the first and/or second transfer device is/are adapted to feed simultaneously a multiplicity of identification objects to the buffers of the rotatable sorting device, the transfer buffer and/or the first magazine.

* * * * *